US008605921B2

(12) United States Patent
Hesdahl

(10) Patent No.: US 8,605,921 B2
(45) Date of Patent: Dec. 10, 2013

(54) LOUDSPEAKER POSITIONS SELECT INFRASTRUCTURE SIGNAL

(75) Inventor: Piet Bernard Hesdahl, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 3070 days.

(21) Appl. No.: 10/510,782

(22) PCT Filed: Mar. 11, 2003

(86) PCT No.: PCT/IB03/00953

§ 371 (c)(1),
(2), (4) Date: Oct. 12, 2004

(87) PCT Pub. No.: WO03/088711

PCT Pub. Date: Oct. 23, 2003

(65) Prior Publication Data

US 2005/0141724 A1 Jun. 30, 2005

(30) Foreign Application Priority Data

Apr. 17, 2002 (EP) ..... 02076496

(51) Int. Cl.
*H04R 5/02* (2006.01)

(52) U.S. Cl.
USPC ..... 381/304; 381/300

(58) Field of Classification Search
USPC ..... 381/58–59, 77–85, 300, 307, 303, 305, 381/56, 304
See application file for complete search history.

(56) References Cited

U.S. PATENT DOCUMENTS

| | | | | |
|---|---|---|---|---|
| 6,091,826 | A * | 7/2000 | Laitinen et al. | 381/82 |
| 6,195,435 | B1 * | 2/2001 | Kitamura | 381/18 |
| 6,385,322 | B1 * | 5/2002 | Mietling | 381/82 |
| 6,798,889 | B1 * | 9/2004 | Dicker et al. | 381/303 |
| 6,934,396 | B1 * | 8/2005 | Leapman | 381/59 |
| 8,170,245 | B2 * | 5/2012 | Neidich et al. | 381/305 |
| 2002/0086684 | A1 * | 7/2002 | Pande et al. | 455/456 |

FOREIGN PATENT DOCUMENTS

| | | | |
|---|---|---|---|
| EP | 1146775 | A2 | 10/2001 |
| WO | WO 96/29779 | A2 | 9/1996 |

* cited by examiner

*Primary Examiner* — Disler Paul

(57) ABSTRACT

For operating a multi-loudspeaker configuration which is audio-driven from a multi-audio-channel source system, an appropriate audio channel from the multi-audio-channel source is assigned to each loudspeaker. The loudspeakers are driven as active powered units. In particular, the method provides an overall communication structure for carrying audio data to the loudspeakers. The method locally ascertains the relative positions of various loudspeakers in the configuration. It assigns an appropriate indication to a particular loudspeaker regarding its relative position. In the particular loudspeaker, it recognizes an associated indication. It uses a recognized indication to select an audio channel appropriate to the position of the loudspeaker in question in the multi-loudspeaker configuration.

20 Claims, 2 Drawing Sheets

LOUDSPEAKER POSITIONS SELECT INFRASTRUCTURE SIGNAL

The invention relates to a method of operating a multi-loudspeaker configuration which is audio-driven from a multi-audio-channel source system as described in the pre-characterizing part of claim 1.

In many current home audio and home cinema systems, various loudspeakers are connected through interconnection wires to an audio control center or an audio preamplifier facility. Such systems may have multiple loudspeakers in various different, and sometimes even time-varying configurations. The number of loudspeakers that is actually active may vary from one in a monosystem to relatively high numbers such as up to eight in quadrophonic, surround and other sophisticated set-ups. A standard policy for interconnecting the loudspeakers is to provide each loudspeaker box, or loudspeaker for short, with its own wire or wires interconnected to the central station. Such a wire would provide the power, as well as the information to the loudspeaker in question. Changing the system configuration, or even changing to a different audio representation, such as from a two-channel to an eight-channel representation could necessitate rewiring of the system.

Prior art has recognized the possibility to separate the routing of the audio data from the provision of power to the loudspeakers, such as by using a pre-existing powerline network to carry data as an additional feature of such a network. Appropriate filtering between data and power would allow the loudspeaker to get the audio amplified and outputted. Another proposal has used wireless communication of the data to the loudspeakers.

However, the inventor has recognized a user's difficulties when the wrong audio channel is assigned to a particular loudspeaker, for example, through an erroneous location and/or erroneous wiring of the loudspeaker in question.

It is therefore an object of the present invention to allow an easy set-up procedure which ensures that each respective loudspeaker gets its assigned correct audio channel.

According to one of its aspects, the invention is characterized as defined in the characterizing part of claim 1.

The invention also relates to an audio reproduction system which may comprise a multi-loudspeaker configuration, which system is arranged to implement a method as defined in claim 1, and to an active loudspeaker arranged for use in such a system. Further advantageous aspects of the invention are defined in the dependent claims.

These and further aspects and advantages of the invention will be discussed in more detail hereinafter with reference to the disclosure of preferred embodiments, and in particular with reference to the appended Figures in which FIG. 1 shows a multi-loudspeaker audio configuration;

Figure 1:
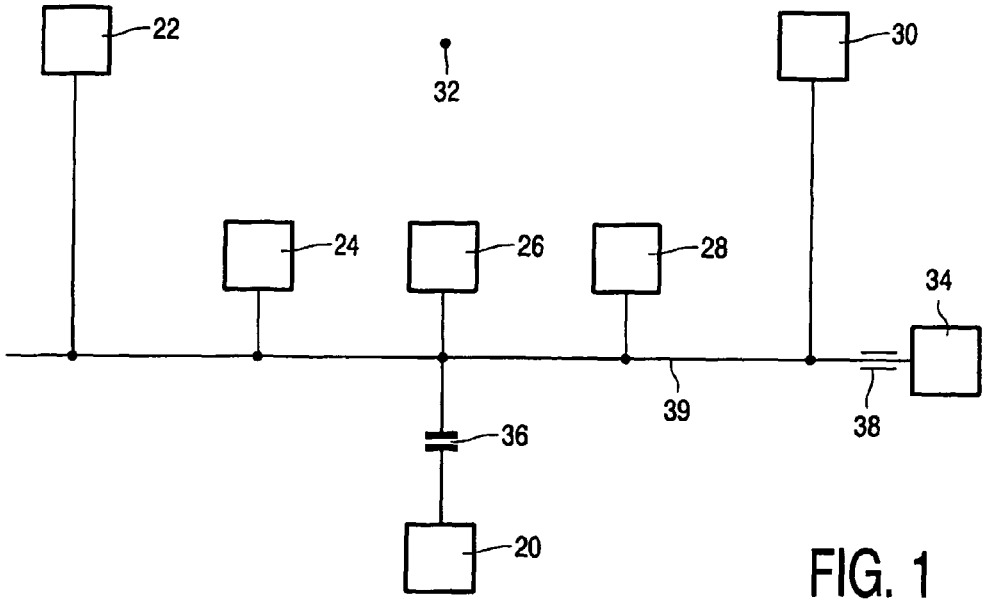

FIG. 1 illustrates a multi-loudspeaker audio configuration shown, by way of example, from above. Note that not all loudspeakers need to be positioned in a single plane. In the Figure, an audio source control station 20 generates multi-stream audio information. Through separation filter 36, shown as being capacitive for blocking low-frequency signals, this information is superimposed on a powerline 39. All interconnections have been shown as single-wire, although in practice, two wires are often used in parallel. The powerline is powered by power source 34 through separation filter 38 shown as being inductive for blocking high-frequency signals. In the configuration shown, there are five loudspeaker boxes 22, 24, 26, 28, 30, which are positioned with respect to a user 32 in such a way that they provide an optimum audio reproduction. For this reason, each loudspeaker should receive appropriate audio channel information. In certain situations, two or more loudspeakers may share an audio stream, for example, when reproducing mono or stereo audio with a larger number of loudspeakers, such as five in the configuration shown. Moreover, the various loudspeakers may vary in actual power level, spectrum, etc., such as in woofers or tweeters, or the like. A skilled listener will recognize that the configuration could become erroneous through the interchange of two or more loudspeakers, and/or through a displacement of one or more of the loudspeakers outside an appropriate optimum range. The present invention therefore provides a system ensuring that the appropriate channel is assigned to a particular loudspeaker, and provides a user with information about rearranging the loudspeakers. Other possibilities for the audio stream are a wired data network, a telephone network, or another wireless communication network.

Figure 2:
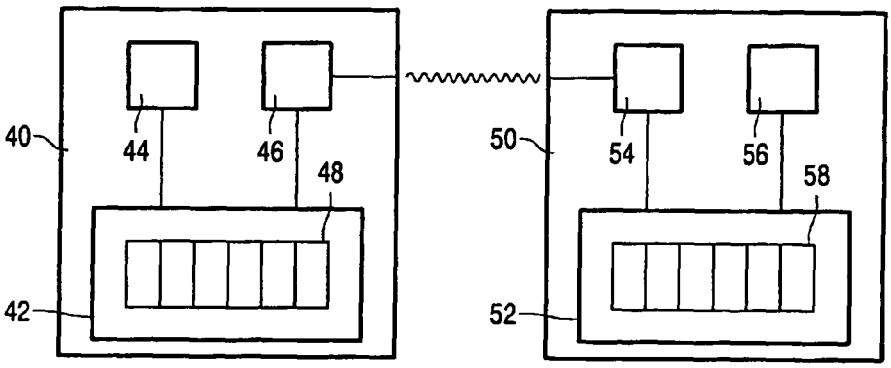
FIG. 2 shows a two-loudspeaker GPS-based approach.

FIG. 2 illustrates a two-loudspeaker GPS-based approach. For simplicity, only the data processing elements have been shown. Each loudspeaker 40, 50 has a GPS facility 44, 54 for determining the actual position of the loudspeaker in question. Furthermore, the loudspeaker has a communication facility 46, 56, which may communicate with the other loudspeaker(s) and/or with the central control box such as item 20 in FIG. 1. Finally, each loudspeaker 40, 50 has a local processing facility 42, 52, which contains a register set 48, 58 and receives the local position of the various loudspeakers for processing and storage. Through careful consideration thereof, the correct assignment of the various channels to the respective loudspeakers could be performed. By way of embodiment, the processing of the various positional data could be executed in central control box 20 in FIG. 1. As regards accuracy of GPS and similar measuring procedures, it is well known that sub-meter accuracies have been proved feasible, which would be quite sufficient in a domestic or similar environment. Note in particular that systematic errors which influence all position determinations for the configuration in question are inconsistent: only the relative positions of the loudspeakers viz à viz each other will be relevant.

In the two-channel set-up, the outcome of the position determinations could be, for example, left and right interchanged, too far apart, too close to each other, and correct. The correct configuration could imply, for example, a distance between the two loudspeakers of two meters minimum, five meters maximum.

Figure 3:
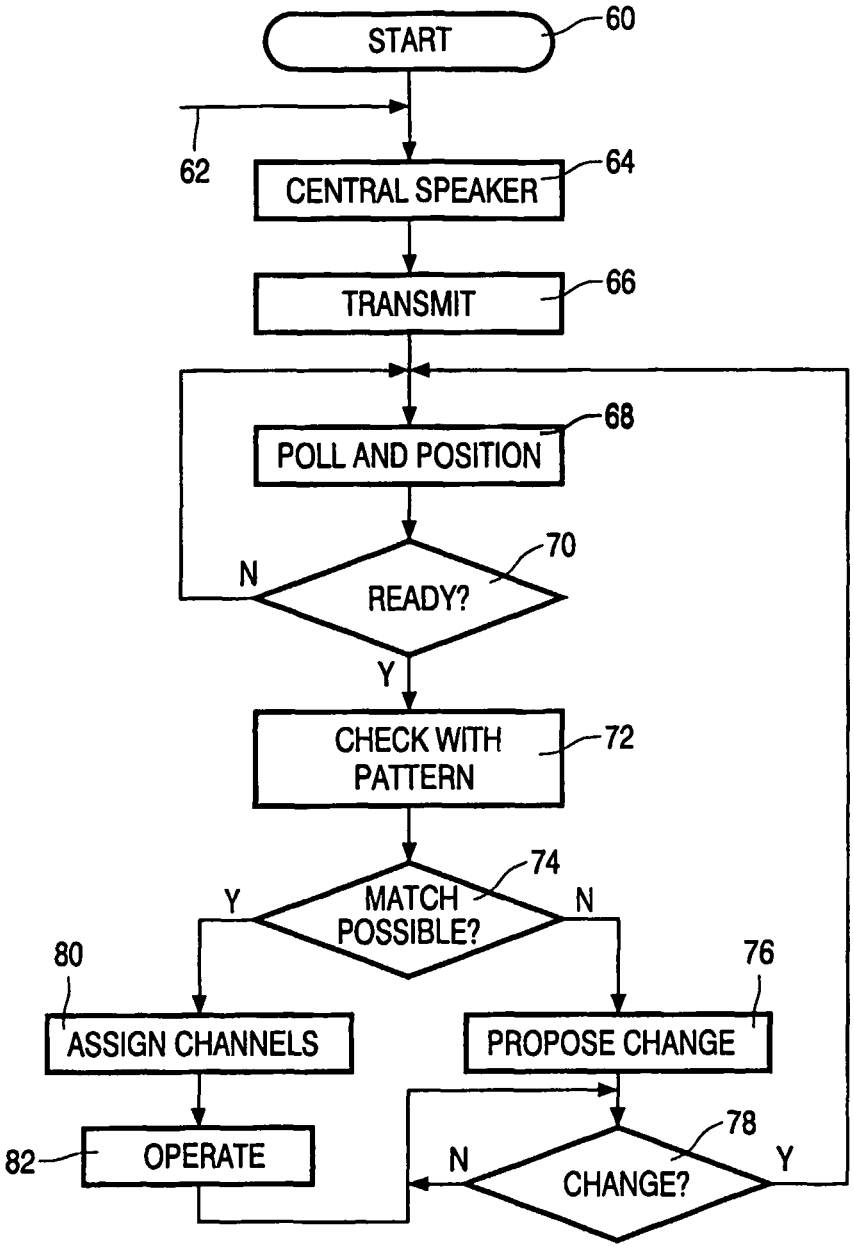
FIG. 3 shows a GPS-based approach to an operating flow chart.

FIG. 3 illustrates a GPS-based approach to an operating flow chart. In block 60, the system is started up, and the necessary hardware and software facilities are assigned. In block 64, the central loudspeaker is addressed by the control box (item 20 in FIG. 1). If appropriate, the control box may be co-located with the central loudspeaker. The control box determines the GPS location of the central loudspeaker (item 26 in FIG. 1), and also, by means of an internal compass of the latter, its orientation. If appropriate, these data are transmitted next to the central control box. In block 68, the central control box will poll one of the other loudspeakers and retrieve the position thereof. Generally, but not by way of restriction, it will not be necessary to again find the compass orientation of the other loudspeakers. In block 70, central control finds out whether all loudspeakers have reported. If not, the system goes on polling in block 68.

If ready, the system checks, in block 72, the actual loudspeaker configuration so found against a standard pattern of the loudspeakers. For one, this compares with a scale factor, such as determined through comparison with an optimum distance between outer loudspeaker pair 22, 30 in FIG. 1. Next, central control tries to match the actual loudspeaker configuration with an optimum configuration. For example, if loudspeakers 24, 28 have identical facilities, they could be exchanged without other problems than the necessary correct assignment of the associated left/right audio data streams. However, other exchanges could be forbidden. Also, variations in the distances between adjacent loudspeakers could be different from the optimal conditions. Generally, the procedure followed is democratic in that the actual overall configuration of the loudspeakers is determined and checked against a standard configuration, without the checking being preferably based on only a subset of all loudspeakers in the actual configuration.

In block 74, central control checks whether a suitable match can be made between the actual and the optimal configuration. If wrong, the system proposes a change in block 76, by proposing to move the outmost loudspeakers in a direction towards or away from the center. If a change executed by the user is detected in block 78, the polling procedure is repeated, from block 68 on as shown, or even by a retry, starting with block 64 through arrow 62. However, if the configuration is acceptable, the various correct channels are assigned in block 80 to the loudspeakers, and in block 82, the system will be operated accordingly. Here again the change detection in block 78 may remain active. If no change occurs, this block 78 operates as a waiting loop. The overall organization has been simplified for better understanding. The step of leaving the operation has been omitted. Furthermore, the system may have an overruling feature, if the user does not want to produce an optimal configuration at the present moment.

Figure 4:
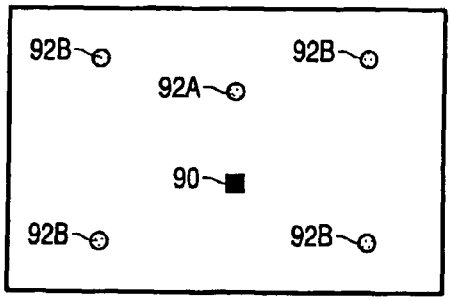
FIG. 4 shows a template-based setting embodiment for a single loudspeaker.

FIG. 4 illustrates a template-based setting embodiment for a single loudspeaker. The inventor has recognized that this is a particularly user-friendly and low-cost solution for the instant problem. The intended placement diagram or template has been provided at the rear side of each loudspeaker box. In every position in the placement diagram (again as seen from above) where a loudspeaker may be placed, a light-emitting device or other indication element such as a LCD is mounted. By pressing a single pushbutton 90 or other similar element, a single light-emitting device 92A, 92B can be lit, to indicate where the box in question is located. Pressing the pushbutton 90 will toggle between the various positions, such as according to a standard sequence. In the LEDs, a red light 92A will indicate a "selected" position, whereas green positions 92B are "available". After selection, the loudspeaker will be able to receive and output the correct audio channel in accordance with this selection.

The invention claimed is:

1. A method comprising:

providing a communication infrastructure for carrying audio data from a multi-channel source to a plurality of loudspeakers;

ascertaining relative positions of the plurality of loudspeakers;

providing an indication to a first loudspeaker of the plurality of loudspeakers regarding its relative position among the plurality of loudspeakers;

and using the indication at the first loudspeaker to select an audio channel appropriate to the indication of relative position of the first loudspeaker.

2. The method of claim 1, including providing an indication of relative position to each other loudspeaker of the plurality of loudspeakers and using the indication of relative position at each other loudspeaker to select an audio channel appropriate to the indication of relative position of each other loudspeaker.

3. The method of claim 1, wherein the relative positions are ascertained through a self-operative position determination procedure among the plurality of loudspeakers.

4. The method of claim 3, wherein the position determination procedure includes a GPS procedure.

5. The method of claim 4, wherein the position determination procedure is based on the relative positions of all of the plurality of loudspeakers.

6. The method of claim 1, wherein relative positions are user-selected through a position template provided on one or more of the loudspeakers.

7. The method of claim 1, wherein the infrastructure includes at least one of a powerline network, a wired data network, a telephone network, and a wireless communication network.

8. An audio system comprising:

a plurality of loudspeakers, a communication infrastructure that is configured to carry audio data from a multi-channel source to the plurality of loudspeakers, a controller that is configured to ascertain relative positions of the plurality of loudspeakers and to provide an indication to a first loudspeaker regarding its relative position among the plurality of loudspeakers, wherein the first loudspeaker is configured to receive the indication of its relative position and to select an audio channel appropriate to the relative position of the first loudspeaker.

9. The system of claim 8, wherein the controller is configured to ascertain the relative positions through a self-operative position determination procedure among the plurality of loudspeakers.

10. The system of claim 9, wherein each loudspeaker includes a GPS position determination device.

11. The system of claim 8, wherein one or more of the loudspeakers includes a selection facility for user-selecting relative positions using a position template provided on the one or more loudspeakers.

12. The system of claim 8, wherein each loudspeaker of the plurality of loudspeakers is an active powered unit that is configured to drive one or more speakers based on audio data received on the selected channel.

13. The audio system of claim 8, wherein the multi-channel source includes a surround-sound source, and the relative positions correspond to a standard pattern associated with the rendering of surround-sound audio data.

14. The audio system of claim 8, wherein the first loudspeaker is configured to select the audio channel based also on audio characteristics of the first loudspeaker.

15. The audio system of claim 8, wherein the controller is configured to provide feedback to a user regarding positioning of one or more of the loudspeakers.

16. The audio system of claim 15, wherein the feedback is based on a preferred positioning of the plurality of loudspeakers for optimal performance.

17. A loudspeaker comprising:

an interface for receiving, from an overall communication infrastructure, audio data from a multi-channel source, and an indication of a relative position of the loudspeaker among a configuration of multiple loudspeakers, and a selector that is configured to select an audio channel appropriate to the relative position of the loudspeaker.

18. The loudspeaker of claim 17, including a GPS facility that is configured to provide an absolute position from which its relative position viz à viz the configuration of the multiple loudspeakers.

19. The loudspeaker of claim 17, wherein the interface includes a position template that is configured to receive the indication of the relative position via a user-input.

20. The loudspeaker of claim 17, including an active powered unit that is configured to drive one or more speakers based on audio data received on the selected channel.

* * * * *